US007536958B2

(12) United States Patent
Bravo et al.

(10) Patent No.: US 7,536,958 B2
(45) Date of Patent: May 26, 2009

(54) PASSENGER RAIL CAR

(75) Inventors: Raul V. Bravo, Vienna, VA (US); Claudio R. Bravo, Gainesville, VA (US); Robin Hazy, Summit Point, WV (US); George F. Lobstein, Arlington, VA (US)

(73) Assignee: Raul V. Bravo & Associates, Inc., Reston, VA (US)

( * ) Notice: Subject to any disclaimer, the term of this patent is extended or adjusted under 35 U.S.C. 154(b) by 206 days.

(21) Appl. No.: 11/546,547

(22) Filed: Oct. 12, 2006

(65) Prior Publication Data

US 2007/0261591 A1 Nov. 15, 2007

Related U.S. Application Data

(60) Provisional application No. 60/798,773, filed on May 9, 2006.

(51) Int. Cl.
*B61D 15/06* (2006.01)
*B61D 17/00* (2006.01)
*B60N 5/00* (2006.01)

(52) U.S. Cl. ..... 105/392.5; 105/397; 105/340

(58) Field of Classification Search ..... 105/392.5, 105/397, 340; 296/187.03, 187.09, 187.11, 296/190.03

See application file for complete search history.

(56) References Cited

U.S. PATENT DOCUMENTS 2,662,488 A * 12/1953 Clary ..... 105/62.2
2,811,932 A * 11/1957 Clary ..... 105/340
3,868,908 A * 3/1975 Pelabon ..... 105/1.4
4,184,434 A * 1/1980 Chapin ..... 105/456
D315,536 S 3/1991 Rader
5,063,859 A * 11/1991 Rader ..... 105/340
5,458,066 A * 10/1995 Ishida et al. ..... 105/401
6,158,356 A * 12/2000 Hachet et al. ..... 105/392.5
6,561,105 B2 * 5/2003 Godin et al. ..... 105/396
6,712,007 B2 * 3/2004 Yamamoto et al. ..... 105/392.5
6,886,474 B2 * 5/2005 Yamamoto et al. ..... 105/397
2004/0159263 A1 * 8/2004 Yamamoto et al. ..... 105/392.5
2007/0186802 A1 * 8/2007 Gough ..... 105/392.5
2007/0261591 A1 * 11/2007 Bravo et al. ..... 105/392.5

OTHER PUBLICATIONS

"7700 series All stainless steel push-pull type passenger car", *Maryland Department of Transportation, U.S.A.*, 1 pg.

"Section—Commuter Car", *Morrison Knudsen*, Oct. 22, 1991, 1 pg.

"All stainless steel DC electric railcar for commuter service", 1 pg.

(Continued)

*Primary Examiner*—S. Joseph Morano
*Assistant Examiner*—Jason C Smith
(74) *Attorney, Agent, or Firm*—Foley & Lardner LLP

(57) ABSTRACT

A passenger rail car includes a lower passenger compartment that includes a plurality of passenger seats. The passenger rail car also includes an upper passenger compartment that includes a plurality of passenger seats. A control cab for a rail car operator is elevated above the floor of the lower passenger compartment, and is located forward of the passenger seats and behind the crash energy management region. The front end of the passenger rail car may be slanted to provide a greater field of view for the rail car operator.

17 Claims, 15 Drawing Sheets

OTHER PUBLICATIONS

"All stainless steel Bi-level push-pull type passenger car", 1 pg.

"U.S. Secretary of Transportation Norman Y. Mineta Unveils New Commuter Rail Safety System that is Being Tested, May Make Millions of Train Riders Safer During a Crash", *U.S. DOT*, Mar. 23, 2006, 3 pgs., http://www.dot.gov/affairs/dot4106.htm.

"Regulatory Overview", Safety Rulemaking, Reports, and Program Development, *U.S. DOT Federal Railroad Administration*, Aug. 17, 2006, pp. 1-45.

United Stated States Public Laws, 103rd Congress—2nd Session, Lexsee 103 P.L. 440 [H.R. 4867], Nov. 2, 1994, pp. 1-14.

Lexsee 64 FR 25540, Federal Register vol. 64, No. 91, *U.S. Department of Transportation, Federal Railroad Administration*, May 12, 1999, pp. 1-294.

Lexsee 65 FR 41284, Federal Register vol. 65, No. 128, *U.S. Department of Transportation, Federal Railroad Administration*, Jul. 3, 2000, pp. 1-51.

Lexsee 67 FR 19970, Federal Register vol. 67, No. 78, *U.S. Department of Transportation, Federal Railroad Administration*, Apr. 23, 2002, pp. 1-44.

Lexsee 67 FR 42892, Federal Register vol. 67, No. 122, *U.S. Department of Transportation, Federal Railroad Administration*, Jun. 25, 2002, pp. 1-36.

Acela Train Brochure (1995) and Photographs Illustrating Front Structure (6 pages).

Federal Register vol. 72, No. 147 Aug. 1, 2007 Proposed Rules.

* cited by examiner

PASSENGER RAIL CAR

RELATED APPLICATIONS

This application claims priority to U.S. provisional patent application Ser. No. 60/798,773, entitled "Passenger Rail Car", filed with the U.S. Patent and Trademark Office on May 9, 2006, which is incorporated in its entirety herein by reference.

FIELD OF THE INVENTION

The invention relates generally to passenger rail cars; and, in particular, to a multi-level passenger rail car having a forward control cab.

DESCRIPTION OF THE RELATED ART

In order to promote greater safety of conventional intercity and commuter railroads which operate on the general railroad system with other trains including freight trains, the federal government has promulgated regulations governing passenger rail safety and equipment. Local jurisdictions and operators acquiring new passenger trains for conventional intercity and commuter service have complied with and in some cases exceeded these regulations. For instance, one jurisdiction initiated a procurement for passenger equipment requiring crash energy management (CEM) or crush zones to be provided at both ends of each passenger rail car, to help absorb the impact of a collision with another train, or with an object or a vehicle at a highway-rail grade crossing. Other jurisdictions are similarly considering application of CEM for passenger railroad operations.

Many conventional passenger trains have a first "cab" car at the front of which is a cab for an operator (engineer), with space for passengers behind the cab, all on the same level. The other rail cars that couple with the cab car also carry passengers. The frontal location of the cab may place the operator at risk of serious injury in the event of a frontal collision.

In order to maximize capacity, passenger rail cars may have multiple levels. Multiple level passenger rail cars are commonly referred to as "bilevels," with seating for passengers on upper and lower levels. As used herein, the term "bilevel" means at least two levels of passenger seating.

Several carbuilders make bilevels that operate in or near various North American cities, including Boston, New York, Washington, San Francisco, Seattle, Toronto, Miami, and Dallas. Some of these cab cars actually include three floor levels: one between the wheel trucks at 25" above top of rail (TOR), one at 51" above TOR at both ends over the wheel trucks, and one at 104" above TOR. The operator's cab is typically positioned at 51" above TOR, and is located at the very front of the rail car. No CEM is provided in such a cab car. Rather, the cab car has a rigid outer shell with no crush zones provided.

Several cab cars used in or around Chicago, Washington and San Francisco have a two-level "gallery" structure, with the lower floor being a full car length at 48" above TOR, and with the upper floor at 104" above TOR. Because of the low clearance between floors of approximately 56", the upper level is split lengthwise to provide ample headroom for passengers standing along the center aisle way of the lower floor. There is a single row of seats on each of the upper level floors, and an open railing on the center side of each of the upper level floors. For this rail car, the control cab is located at the very front of the rail car, at 104" above TOR. There are no CEM features provided, and some passengers may be located next to the operator's cab at the very front of the rail car.

There is also a bilevel rail car that provides intercity services in the State of California. This rail car includes an operator cab on the upper level floor, at 104" above TOR at the very front of the rail car, and there are no CEM features. The passenger passage way between rail cars is provided at 104" above TOR, which makes it incompatible with single level rail cars.

Among the objects of the invention is the provision of a passenger rail car that provides enhanced safety for all car occupants, including the operator, in the event of a frontal collision, and makes efficient use of space and energy.

SUMMARY OF THE INVENTION

According to at least one aspect of the invention, there is provided a bilevel passenger rail car with an elevated operator position and integrated crash energy management. In more detail, there is provided a passenger rail car that includes a lower passenger compartment that includes a plurality of passenger seats. The passenger rail car also includes an upper passenger compartment that includes a plurality of passenger seats. The passenger rail car further includes a crash energy management region provided at a front portion of the passenger rail car. The passenger rail car also includes a control cab for a rail car operator that is elevated above the lower passenger compartment, the control cab being forward of the passenger seats and behind the crash energy management region.

According to another aspect of the invention, there is provided a bilevel passenger rail car with an angled front end and an upper level operator position. In more detail, there is provided a passenger rail car that includes a front end that is slanted to provide a greater field of view for the rail car operator positioned within a control cab provided in a top half section within the passenger rail car.

According to yet another aspect of the invention, there is provided a crash energy management system for a rail car, which includes a forward-end crush zone. The forward-end crush zone includes a plurality of primary energy absorbers horizontally positioned in the crush zone. The forward-end crush zone also includes a plurality of secondary energy absorbers horizontally positioned in the crush zone. The forward-end crush zone further includes a plurality of load transfer plates vertically positioned in the crush zone.

BRIEF DESCRIPTION OF THE DRAWINGS

The foregoing and other objects, advantages and features of the invention will become apparent upon reference to the following detailed description and the accompanying drawings of exemplary embodiments of the invention, in which.

DETAILED DESCRIPTION OF SPECIFIC EMBODIMENTS

Figure 1A:
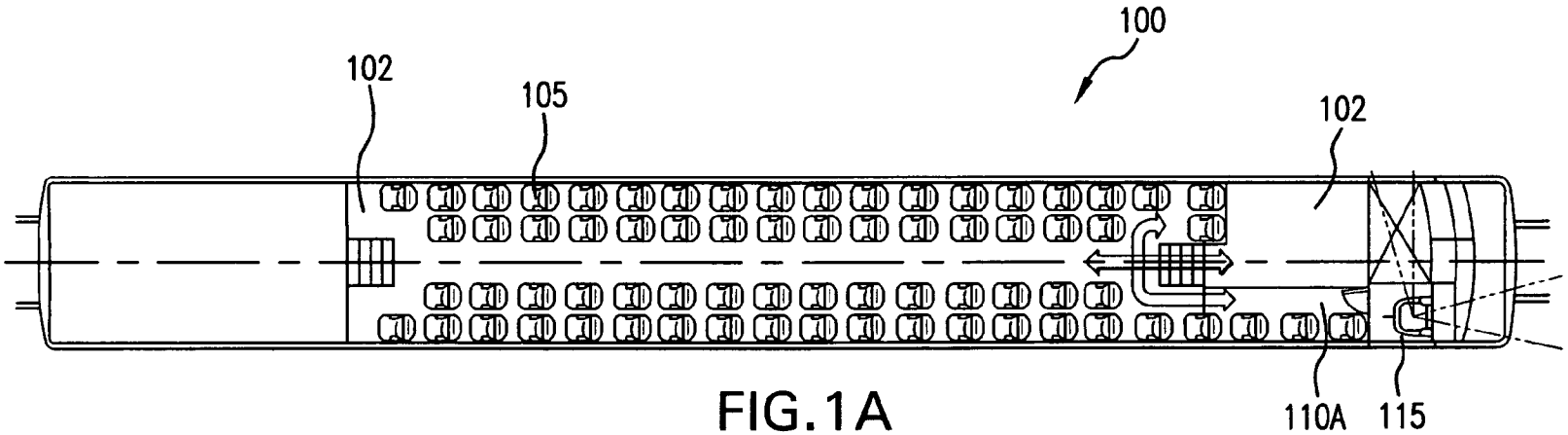
FIG. 1A is a top plan view of the upper passenger compartment of a cab car according to a first embodiment of the invention.
Figure 1B:
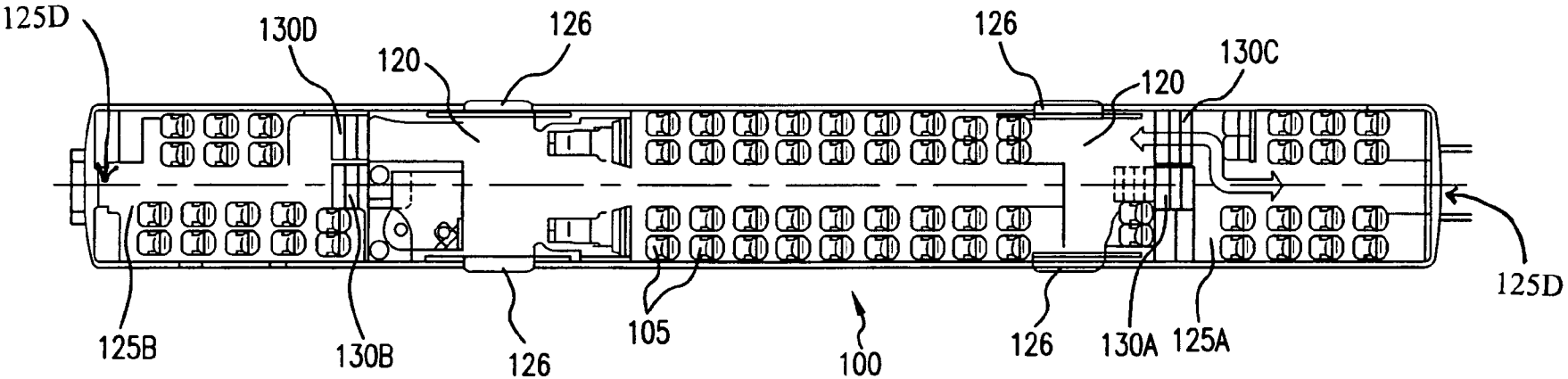
FIG. 1B is a top plan view of the middle and lower passenger compartments of the cab car according to the first embodiment of the invention.
Figure 1C:
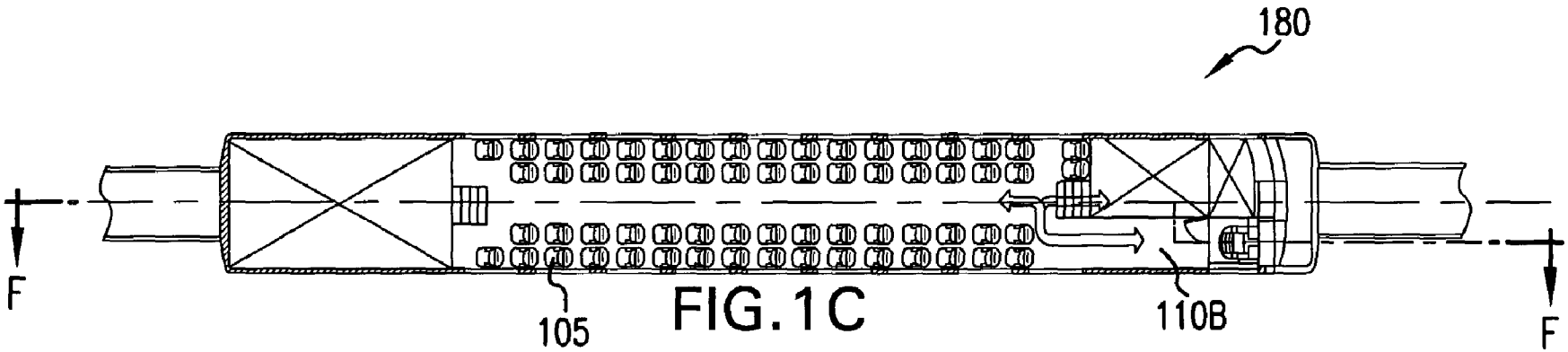
FIG. 1C is a top plan view of the upper passenger compartment of the cab car according to a second embodiment of the invention.
Figure 1D:
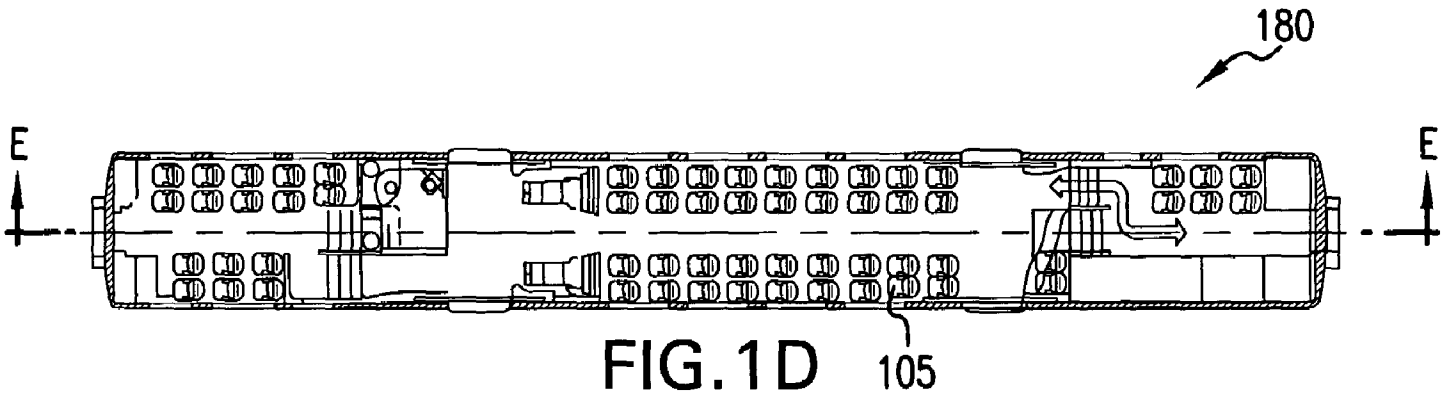
FIG. 1D is a top plan view of the middle and lower passenger compartments of the cab car according to the second embodiment of the invention.
Figure 1I:
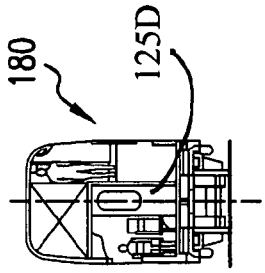
FIGS. 1G, 1H, 1I and 1J are respective widthwise cross-sectional views at different positions along the cab car according to the second embodiment of the invention taken along lines G-G, H-H, I-I and J-J, respectively, in FIGS. 1E and 1F.
Figure 1J:
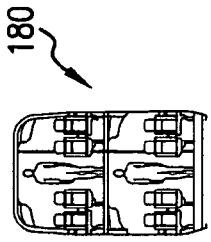
Figure 1E:
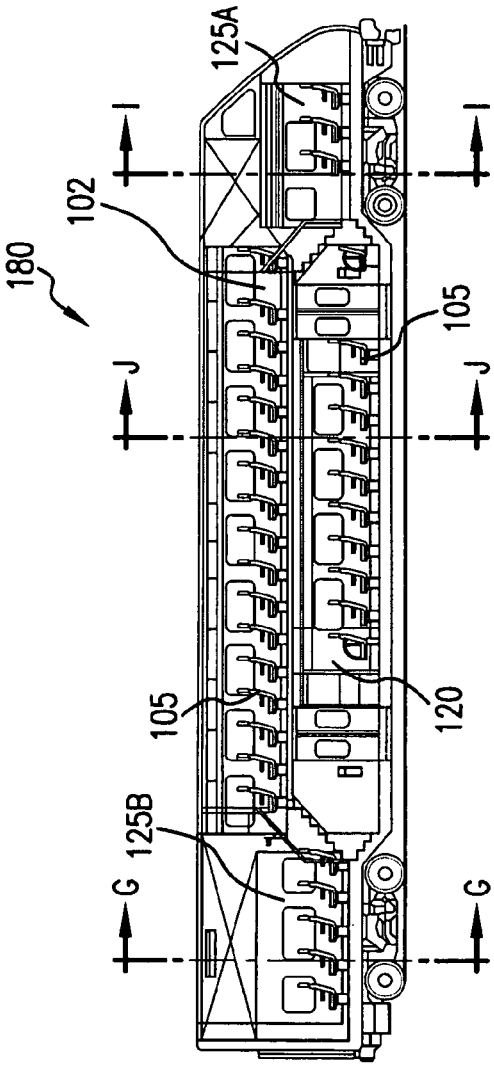
FIG. 1E is a right-side longitudinal sectional view of the cab car according to the second embodiment of the invention taken along line E-E in FIG. 1D.
Figure 1F:
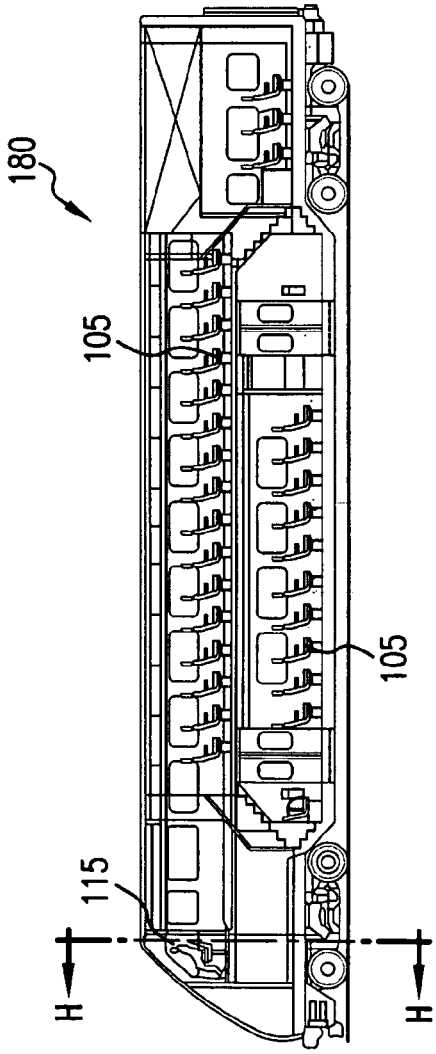
FIG. 1F is a left-side longitudinal sectional view of the cab car according to the second embodiment of the invention taken along line F-F in FIG. 1C.
Figure 1G:
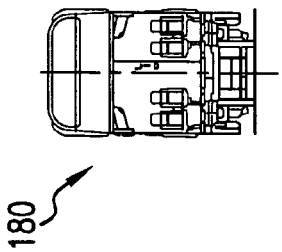
Figure 1H:
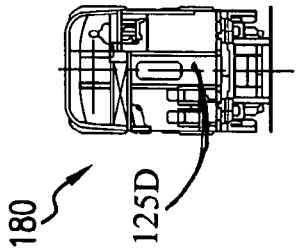

Referring to FIGS. 1A and 1B, in a first embodiment of the invention, there is provided a multi-level cab car 100. The cab car 100 includes a lower passenger compartment level 120 that includes a plurality of passenger seats 105, an upper passenger compartment level 102 that includes a plurality of passenger seats 105, and a middle compartment level 125A, 125B with a plurality of passenger seats 105. The middle compartment has portions 125A, 125B at each end of the cab car 100. Front portion 125A has steps 130A that allow a passenger to move from the front portion 125A to the upper passenger compartment 102, and steps 130C that allow a passenger to move from the front portion 125A to the lower passenger compartment 120. Rear portion 125B has steps 130B that allow a passenger to move from the rear portion 125B to the upper passenger compartment 102, and steps 130D that allow a passenger to move from the rear portion 125B to the lower passenger compartment 120. The front portion 125A ends at a first opening (or door) 125D at one end of the cab car 100, whereby passengers from a forwardly-positioned car of a train of cars can enter into the cab car 100 through that first opening 125D. Similarly, the rear portion 125B ends at a second opening (or door) 125D at the other end of the cab car 100, whereby passengers from a rearwardly-positioned car of the train can enter into the cab car 100 through that second opening 125D. The passengers enter and exit the cab car 100 via side doors 126 at the lower passenger compartment level 120. Side doors (not shown) may also be provided on the middle compartment level 125A, 125B.

By way of example and not by way of limitation, the lower passenger compartment 120 is positioned approximately 25" above top of rail (TOR), the upper passenger compartment 102 is positioned at approximately 104" above top of rail (TOR), and the middle compartment 125A, 125B is positioned at approximately 51" above top of rail (TOR). The middle compartment 125A, 125B extends from each end of the cab car only to the steps 130A-D.

Referring to FIG. 1A, which shows the upper passenger compartment level 102, a protective operator cab (also referred to herein as "protective cab" or "operator cab" or "control cab") 115 is positioned at a front-right end of the upper passenger compartment level 102, behind a crash energy management region (described below). The rail car operator enters and exits the control cab 115 by way of an aisle portion 110A. The aisle 110A and/or the control cab 115 spans approximately one-third (⅓) the width of the cab car 100. Alternatively to what is shown in FIG. 1A, the aisle 110A and control cab 115 may be provided at a front-left end of the upper passenger compartment level 102. This alternative configuration is possible assuming that stairways, seating and other parts of the cab car allow for such a configuration.

At least one extra passenger seat may be positioned adjacent the aisle 110A in the upper passenger compartment 102. By way of example and not by way of limitation, for a cab car having a full width clearance, the upper passenger compartment aisle 110A and/or control cab 115 can extend ⅓ of the full width from one side (e.g., the right side) of the cab car 100.

Referring to FIG. 1B, the lower passenger compartment level 120 is positioned beneath the upper passenger compartment level 102 in the central portion (with respect to a lengthwise direction) of the cab car 100, between stairs 130A, 130C and stairs 130B, 130D, which are adjacent the middle compartment level portions 125A, 125B. Middle compartment level portions 125A, 125B are disposed over the cab car's wheel trucks (not shown), while the lower passenger compartment level 120 is disposed between the wheel trucks. It is preferable that all of the passenger seats 105 face backwards (opposite to the direction of travel), as illustrated, to provide for greater passenger safety in the event of a frontal collision when the cab car 100 is leading. Alternatively, at least some of the passenger seats 105 may face forwards.

FIGS. 1C-1J show several different views of a cab car 180 according to a second embodiment of the invention. In contrast to the first embodiment described above, the aisle 110B of the second embodiment may not be adjacent any passenger seats, thereby allowing greater room for the operator to navigate to and from the control cab 115. The other features shown in FIGS. 1C-1J are also found in the first embodiment.

Figure 2:
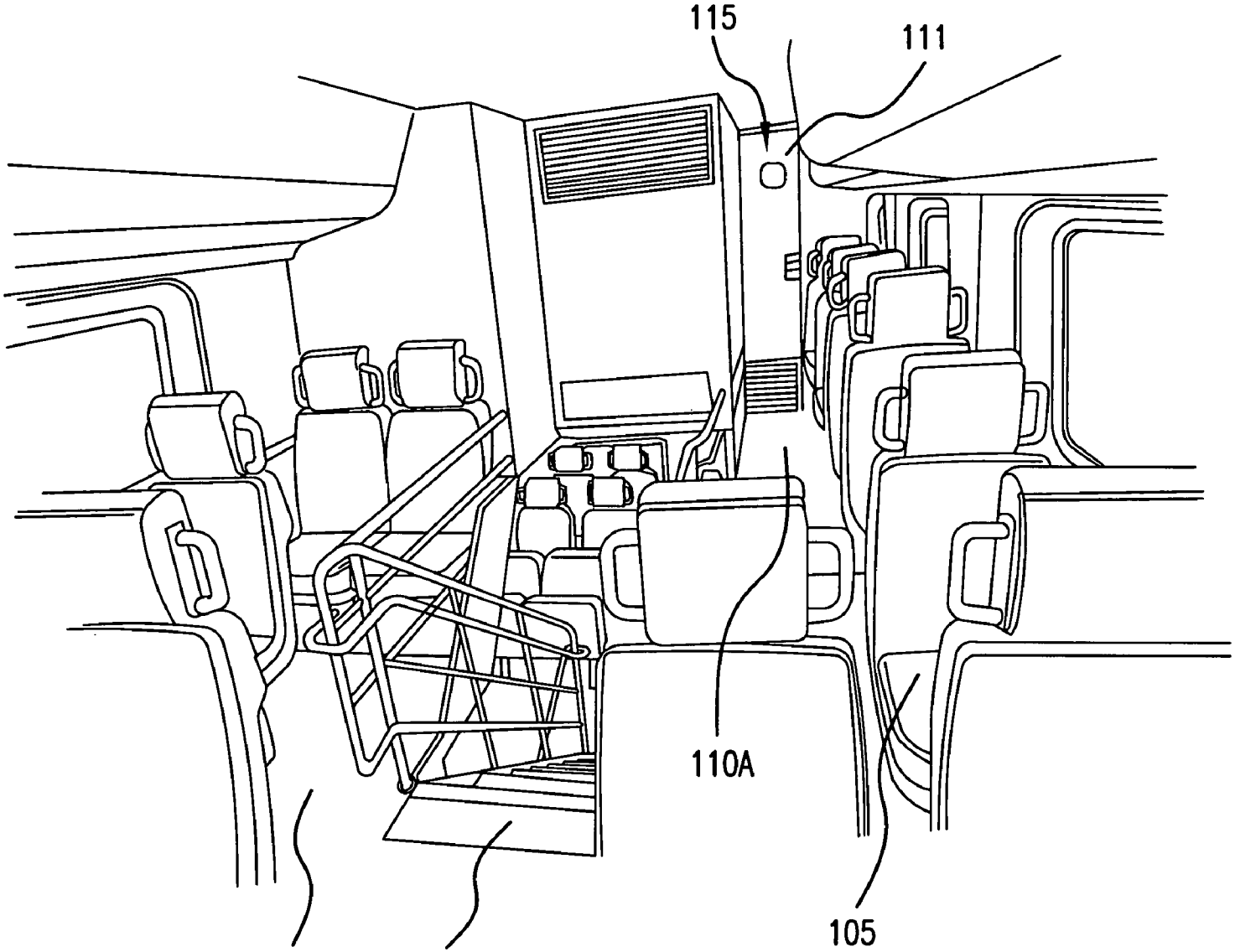
FIG. 2 is a perspective view of the inside of the top level of the cab car according to the first embodiment of the invention.

FIG. 2 shows the front portion of the upper passenger compartment level 102 of the first embodiment of the cab car 100, including the front stairs 130A that connect the upper 102 and middle 125A levels of the cab car 100, the aisle 110A, and the control cab 115. The control cab 115 may be enclosed at the end of the passenger area by a transverse partition and hinged access door 111, to protect the operator in the case of an unruly passenger or other threat. In the first embodiment, the aisle 110A may be positioned adjacent a single column of seats 105 running forward from the steps 130A. A similar view of the second embodiment would omit the right-hand column of passenger seats 105.

A crash energy management region having a crush zone is provided at both ends of the cab car according to the first and second embodiments, whereby, by way of example and not by way of limitation, the crush zone is approximately 60 inches in thickness, and spans the entire width of the cab car at respective front and back ends of the rail car. In the first and second embodiments, the crush zone that is located at the front end of the cab car 100, 180 where the protective cab extends upwards from the bottom portion of the cab car and extends between the bottom portion of the cab car 100 and a bottom surface of the control cab 115. The crush zone may extend the entire distance between the bottom portion of the cab car 100 and the bottom surface of the control cab 115, or the crush zone may extend only partially along the distance between the bottom portion of cab car 100 and the bottom surface of the control cab 115. Since the rail car operator is situated within the protective cab 115 at a high position at the upper passenger compartment height of the cab car, the rail car operator is in a position that would be above the height at which another non-passenger train or a vehicle on a road intersecting the railroad tracks would make impact with the cab car.

The control cab 115 is positioned rearward of collision posts and the crush zone at the front part of the cab car according to the first and second embodiments. To provide the operator with the maximum forward visibility, a lower edge of a windshield is positioned to allow the operator to view the tracks that are located 18 feet and further from the front end of the cab car. There may also be provided a windshield and side window opposite the cab site and an additional windshield between collision posts, to provide for greater viewing angle by the operator. The control cab 115 is located above the mid-level ceiling and next to the rail car passageway, to provide for greater visibility and operator comfort.

With the protective cab 115 being provided at the upper passenger compartment level 102 in the first and second embodiments, the front of the cab car where the protective cab 115 is positioned can be shaped such that resistance to impacting objects, wind or the like is minimized. Due to the positioning of the protective cab 115 for the rail car operator up and back from a conventional position, a slanted front end shape can be provided, whereby impacting objects may be deflected, and faster speeds and more efficient energy consumption can result from such a better design. Furthermore, the rail car operator is provided with a better field of view due to his/her higher position within the rail car as compared to conventional rail car operator locations, and also due to the slanted front end of the cab car that provides for a greater field of view as compared to a vertical or box-shaped front end. Accordingly, the slanted front end shape of a cab car according to third and fourth embodiments, to be described in detail below, are compatible with either of the cab cars according to the first or second embodiments.

Figure 3:
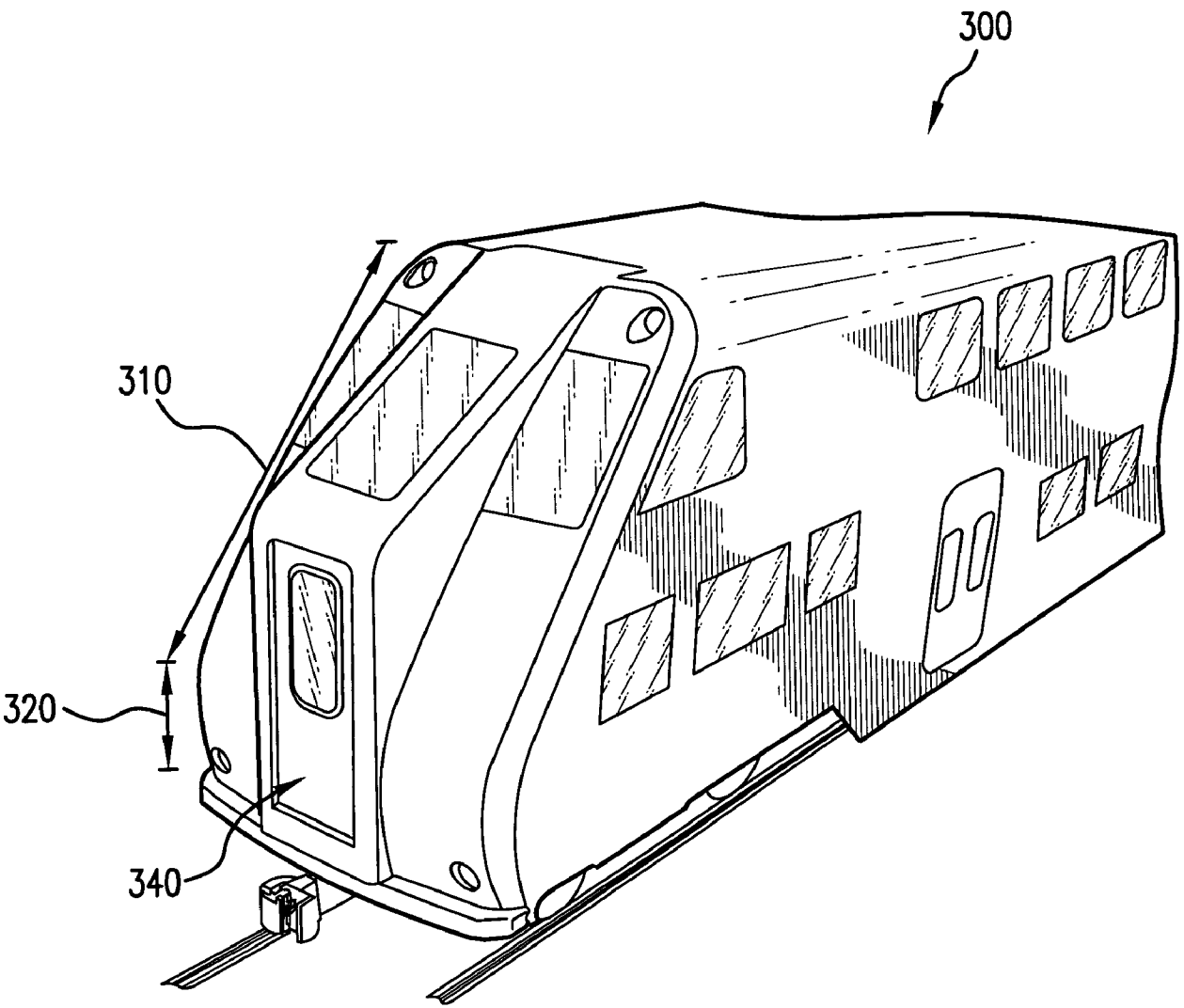
FIG. 3 is a perspective view of the outside of a front portion of a cab car according to a third embodiment of the invention.

In a third embodiment, as shown in FIG. 3, the front end of a cab car 300 has a left-side region (e.g., ⅓ the total width of the cab car) that is mostly slanted, a right-side region (e.g., ⅓ the total width of the cab car) that is mostly slanted, and a box-shaped middle region (e.g., ⅓ the total width of the cab car) having an upright lower portion that includes an entry/exit door, and a slanted top portion. The entry/exit door 340 is provided for enabling passengers to enter and exit the cab car 300 to an adjacent car, or for passage when the train is stationary, in case of emergency if the cab car 300 is the first car in the train. The top (roof) of the box-shaped structure 340 is slanted at a greater angle than the left and right portions of the front end. The slant of the top left- and right-side regions 310 of the front end may be set at a value between 30 degrees and 60 degrees, and the slant of the top portion above the entry/exit door 340 at the middle portion of the front end may be set at a value of 70 to 75 degrees, all as measured from the vertical. Other slant angles are possible, while remaining within the spirit and scope of the invention. The front part of the entry/exit door 340 is substantially upright, to allow for close positioning of door 340 with a door (not shown) provided at the back end of an adjacently coupled car. The lower portions 320 of the left- and right-side regions of the front end are substantially vertical (flat, or straight up and down, with some minor slant possible in some configurations) down to the bottom of the front end.

Figure 4:
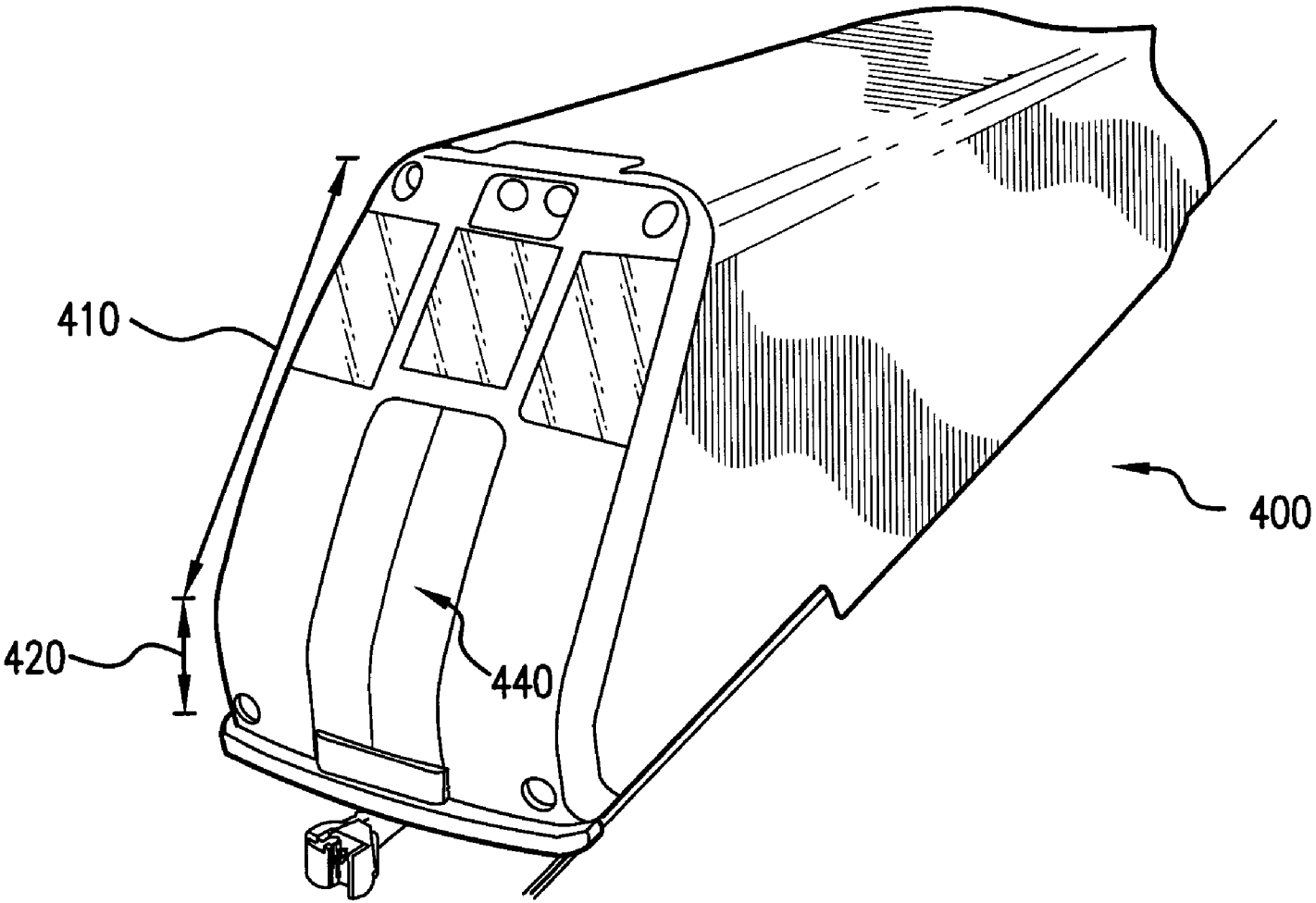
FIG. 4 is a perspective view of the outside of a front portion of a cab car according to a fourth embodiment of the invention.

In a fourth embodiment of a cab car 400, as shown in FIG. 4, a top portion 410 of substantially the entire width of the front end is slanted, except for a lower portion 420 that is not slanted (or that has a minor slant in some possible configurations). A door 440, which is provided at the middle part of the front end according to the fourth embodiment, is also slanted at the same angle. The slant of the top portion 410 of the front end may be set at a value between 30 degrees and 60 degrees from vertical. Other possible angles of the slanted and non-slanted portions of the front end are contemplated, while remaining within the spirit and scope of the invention. In the fourth embodiment as shown in FIG. 4, the door 440 includes a first door portion and a second door portion which are capable of closing the doorway by the first and second door portions coming into contact with each other, and which are capable of opening the doorway by at least one of the first and second door portions moving away from the other one. The door 440 does not extend outward from the slanted front end of the cab car 400, to provide a streamlined front end portion of the cab car.

Figures 5A, 5B:
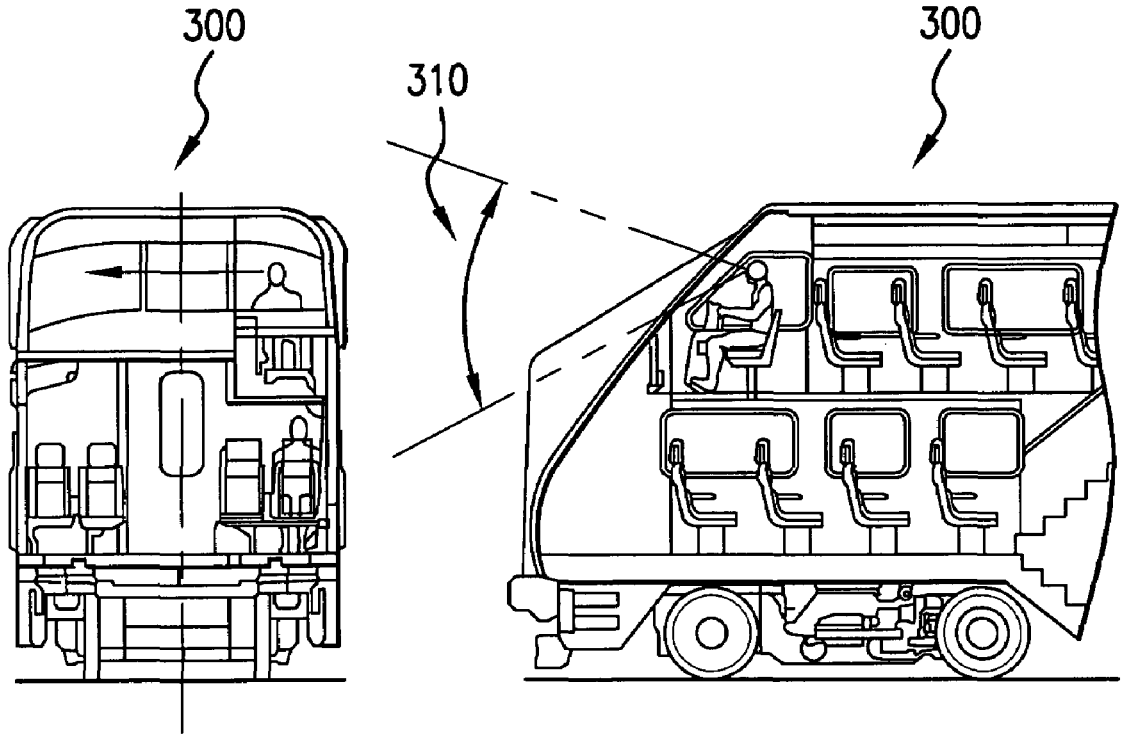
FIG. 5A is a rear elevational sectional view of the front of the cab car according to the third embodiment of the invention.
FIG. 5B is a side elevational sectional view of the front of the cab car according to the third embodiment of the invention.
Figure 6:
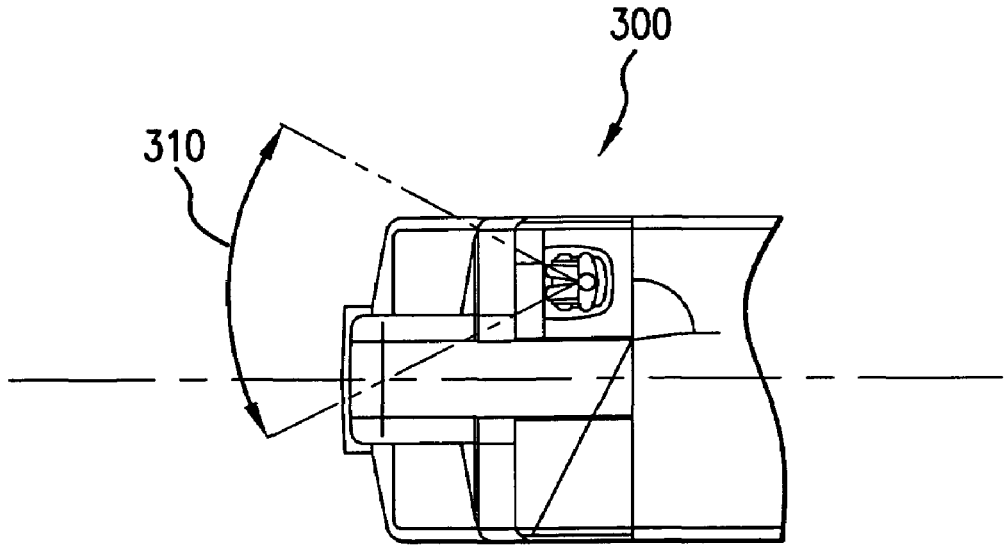
FIG. 6 is a top plan schematic view of the cab car according to the third embodiment of the invention showing outward visibility angles.

FIGS. 5A and 5B are two views, one looking from behind the operator toward the front of the car and one from the longitudinal center of the car facing the right side (cab operator side) of the front end of the cab car 300 according to the third embodiment, in which a large field of view 310 for an operator positioned in the cab can readily be seen. The field of view 310 allows for an operator in the cab to see an object on the rails as close as 18 feet from a front of the rail car. As mentioned earlier, the third embodiment's front end structure is compatible with either the first or second embodiments. FIG. 6 shows the field of view 310 for the operator located within the protective cab of the cab car 300 according to the third embodiment.

Figures 7A, 7B:
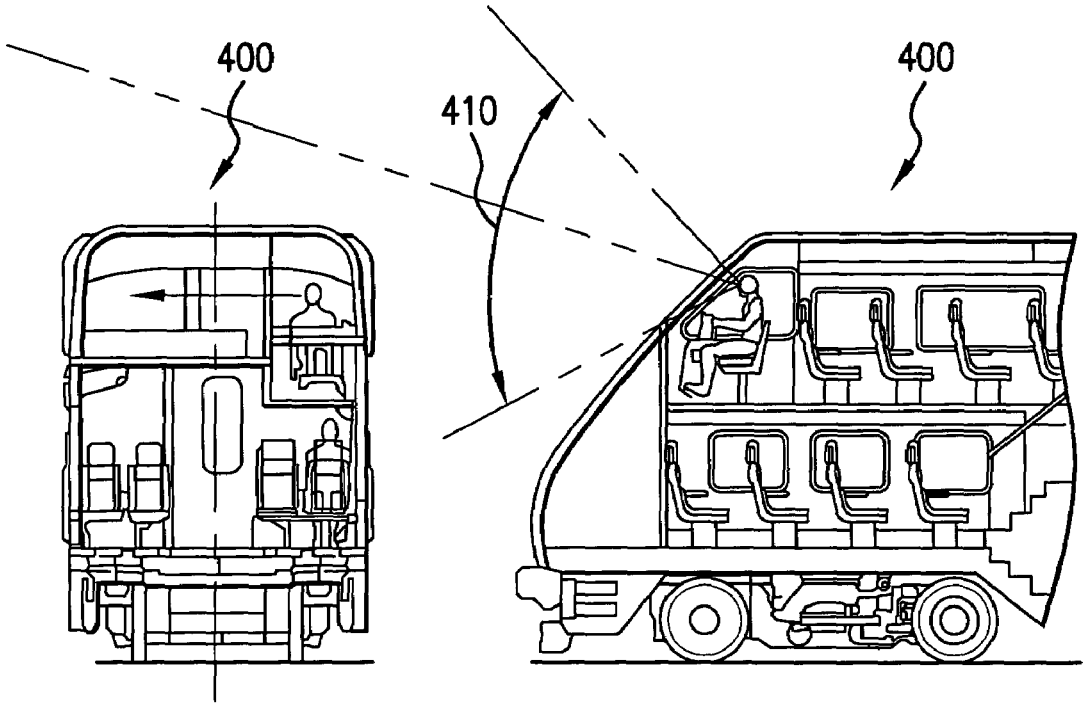
FIG. 7A is a rear elevational sectional view of the front of the cab according to the fourth embodiment of the invention.
FIG. 7B is a side elevational sectional view of the front of the cab car according to the fourth embodiment of the invention.
Figure 8:
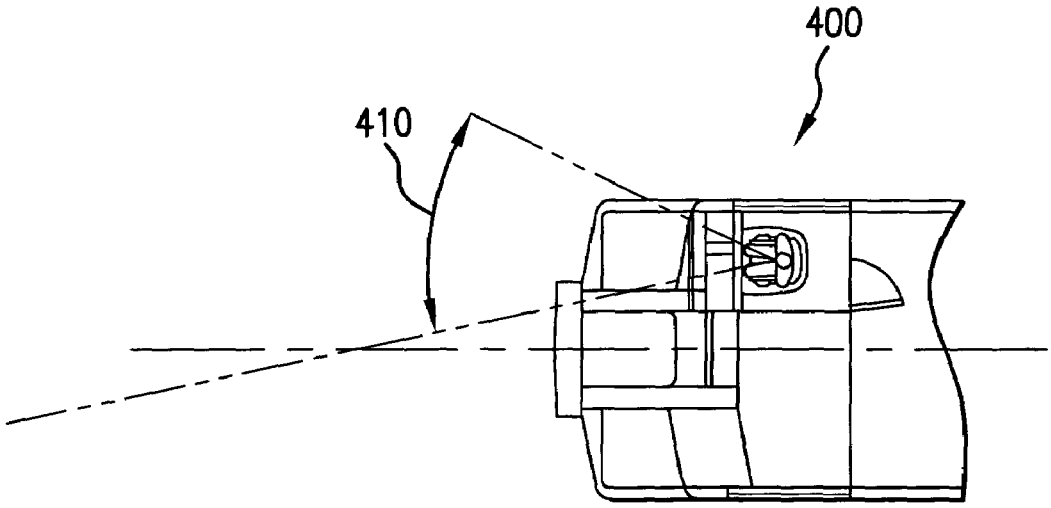
FIG. 8 is a top plan schematic view of the cab car according to the fourth embodiment of the invention.

FIGS. 7A, 7B and 8 are similar to FIGS. 5A, 5B and 6, and show the field of view 410 for an operator positioned in the cab in the cab car 400 according to the fourth embodiment, whereby the fourth embodiment's front end structure is compatible with the either the first or second embodiments.

The Federal Railroad Administration (FRA) regulations, the American Public Transportation Association (APTA) voluntary industry standards, and at least one contract technical specification for one specific procurement require that the occupied volume of a train car that includes the train operator be within a car shell containing collision and corner posts at its extremities. The FRA regulations require collision posts and corner posts at each end of the car. The APTA voluntary industry standards require collision posts at both ends of occupied vehicles, and at part of the end frame, with corner posts at extreme corners of the car body structure and at part of the end frame. The contract technical specification requires collision posts at both sides of the end opening and at part of the end frame, and corner posts at the corners of the car and at part of the end frame.

Figure 9:
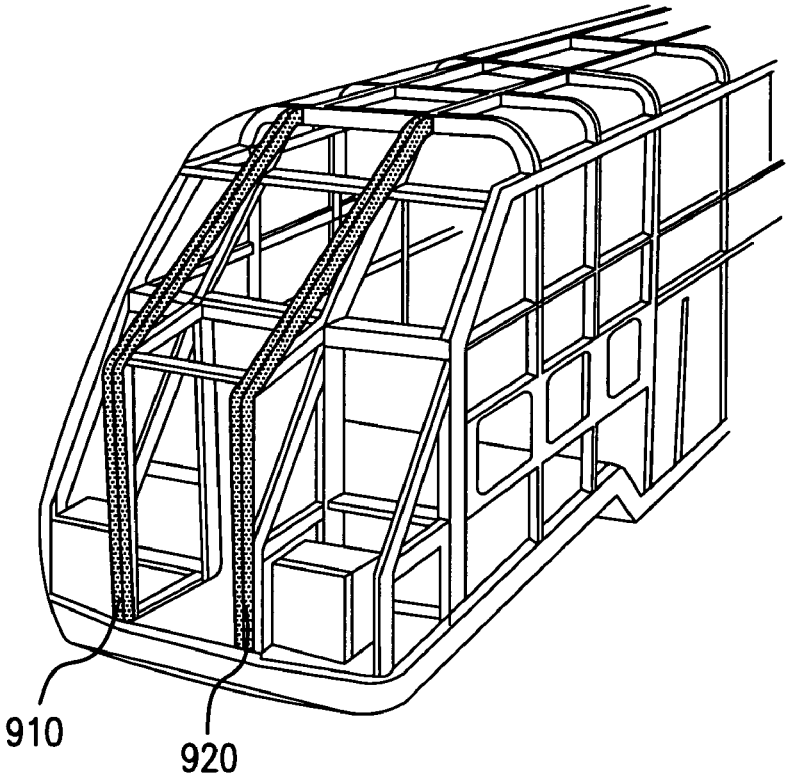
FIG. 9 is a front perspective view of a cab car according to an embodiment of the invention, showing collision posts and crash energy management components according to a first possible implementation.
Figure 10:
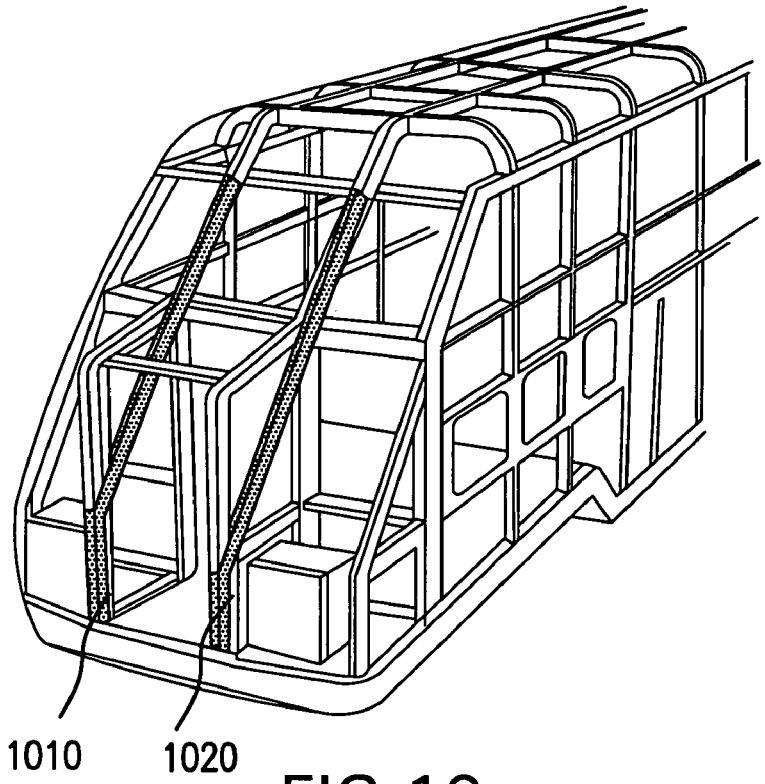
FIG. 10 is a front perspective view of a cab car according to an embodiment of the invention, showing collision posts and crash energy management components according to a second possible implementation.
Figure 11:
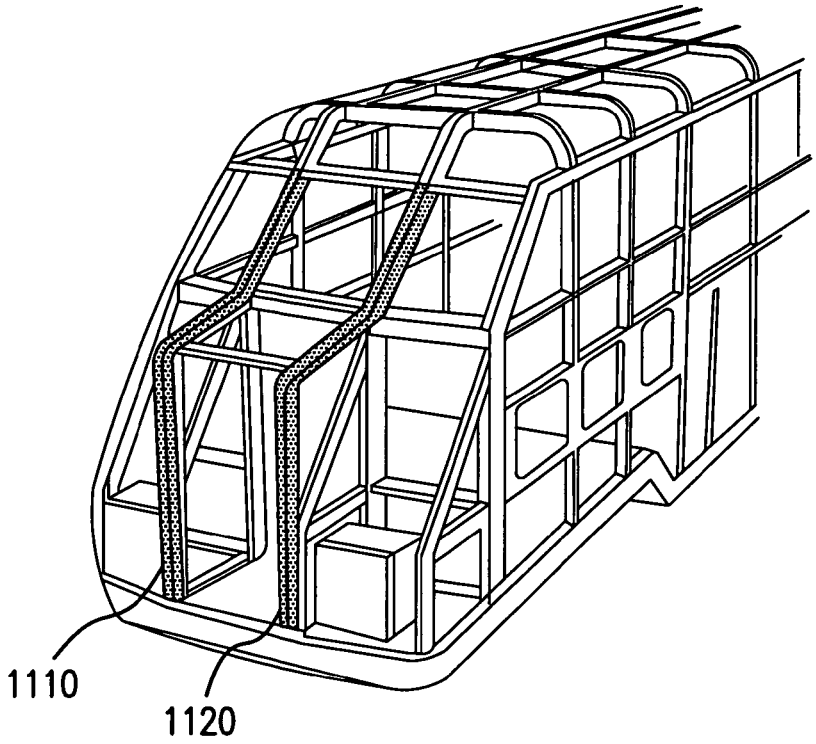
FIG. 11 is a front perspective view of a cab car according to an embodiment of the invention, showing collision posts and crash energy management components according to a third possible implementation.

Different implementations for providing collision posts and corner posts for protecting the front end of the cab car of the first through fourth embodiments are shown in FIGS. 9-12, in which the thick-sized lines correspond to the locations of the collision posts. The regular-sized lines depict the outer frame of the cab car, which supports the outer metal skin (not shown). In particular, FIG. 9 shows two collision posts 910, 920 provided at the front end of the car at opposite sides of the end door of the car, with the collision posts having top portions extending substantially diagonally and having bottom portions extending substantially vertically at the front end of the car. FIG. 10 shows two collision posts 1010, 1020 having a similar construction to the ones shown in FIG. 9, but with longer diagonal portions and shorter vertical portions. FIG. 11 shows two collision posts 1110, 1120 that are provided along the sides of the end door of the car, with diagonal portions, horizontal portions, and vertical portions. In the crush zone construction of FIG. 11, the end door is fully mounted on the collision posts 1110, 1120, providing a simple and strong design.

Figure 12:
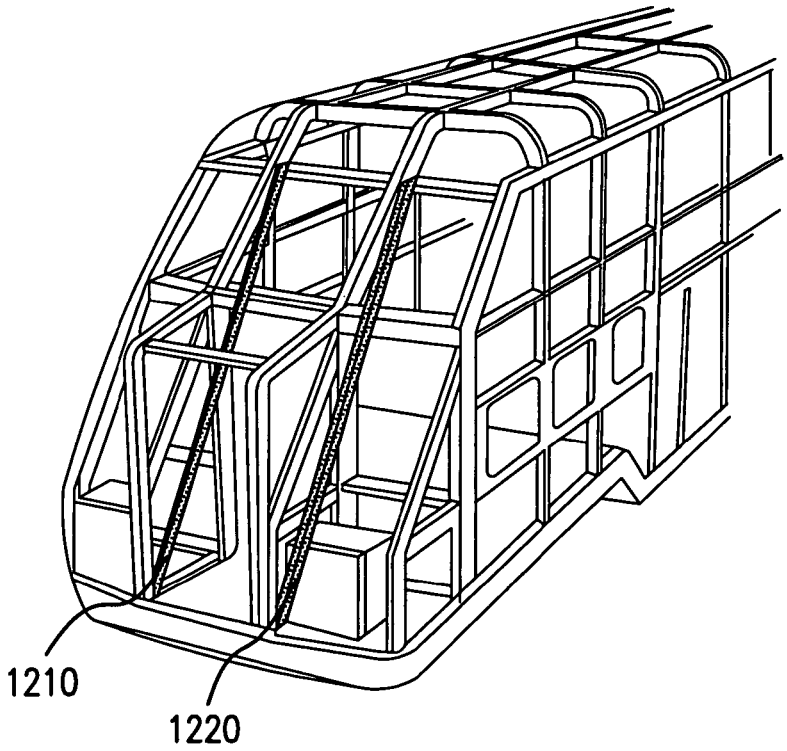
FIG. 12 is a front perspective view of a cab car according to an embodiment of the invention, showing collision posts and crash energy management components according to a fourth possible implementation.

FIG. 12 shows two collision posts 1210, 1220 that extend substantially diagonally from top to bottom at the front of the car. In more detail, the collision posts utilized in a crash energy management system (having a crush zone provided at a front end of a cab car) are located transversely on each side of the end door opening, as provided in each of the four crush zone constructions shown in FIGS. 9-12. Such a construction enables an end sill (which is a component of an underframe structure of a crush zone of the cab car) to transmit the required anti-climber, buffer beam, coupler carrier, coupler shank, and overturning loads into the collision posts in addition to distribution into the draft sill. The collision posts in each of the four constructions shown in FIGS. 9-12 extend from the bottom of an end underframe, vertically to the top of the end door, and then extend at an angle to an anti-telescoping plate at or near the roof level of the cab car. Collision posts are closed box sections and fully penetrate the end underframe and the anti-telescoping plate at or near roof level. The description of the transmission of energy from the crush zone to other components of the rail car will be discussed in detail at a later portion of this specification.

The collision posts are designed to withstand specified static loads and are able to absorb a minimum of 135,000 ft-lbs of energy. When a collision post is overloaded in bending, the top post connection and supporting structure deforms plastically by buckling and bending of the members to accommodate the collision post plastic bending failure. Further, overloading of bottom connections will likely crush or buckle underframe members, whereby shearing or fracturing of the posts is not permissible. The collision posts may be made from light alloy high tensile steel (LAHT), or other suitable material, such as stainless steel.

Like the collision posts, the corner posts are part of the cab car end frame (such as shown in, for example, FIGS. 20 and 21 as reference numeral 2040), but are located at the corners of the cab car. Corner posts are continuously provided from the bottom plate of the end sill to the roof of the cab car. Corner posts extend from the bottom of the end underframe vertically and then extend at an angle to the anti-telescoping plate at or near the roof level of the cab car. Corner posts provide a closed box section and fully penetrate the end underframe and the anti-telescoping plate.

The corner posts are designed to withstand specified static loads and are able to absorb a minimum of 120,000 ft-lbs of energy. When the corner posts are loaded to their yield strength, the yield strengths of the connections and supporting structure to which the corner posts are attached should not be exceeded. Additionally, when the corner posts are overloaded to its ultimate bending strength, the top post connections and supporting structure should withstand the load without failure. Bottom attachments develop the full shear value of the post and overloading of the bottom connections is likely to crush or buckle underframe members, whereby shearing or fracturing is not permissible. The corner posts may be made from low alloy, high strength (LAHT) material, or other suitable material, such as stainless steel.

Given that a crash energy management region having a crush zone is provided on a front end of the cab car, and is encased within the skin of the car, the control cab provided at the top level of the car is positioned further inward from the front of the car than the control cab for conventional cars that do not have crush zones. Rather, a conventional cab car, whether single or bilevel, has a sturdy exterior shell, with no crush zones provided at the ends of the car. In the first and second embodiments, the control cab is positioned behind the crush zone, at an upper level of the car. This provides both better line-of-sight for the operator as well as better protection for the operator in the case of a collision with another train, object, or vehicle at a highway-rail grade crossing. In addition, the crash energy management region enhances safety for passengers in the lead car.

By way of example and not by way of limitation, the crush zone at the cab end is capable of absorbing a total of 3 million foot pounds of energy, within 38 inches of crush of the crushable structure comprising the cab end crush zone. The crush zone at the non-cab end is capable of absorbing a total of 2 million foot pounds of energy, within 24 inches of crush of the crushable structure comprising the non-cab end crush zone.

This is accomplished by the crushing and/or crumbling of components within the crush zone. The crush zone is configured to first impact an object during a collision and crush and/or collapse, if necessary, in a controlled manner to absorb energy from the collision. Collision posts, as required by applicable regulations, are intended to withstand forces up to a certain load without crushing. The collision posts are not necessarily part of the crush zone.

Figure 13:
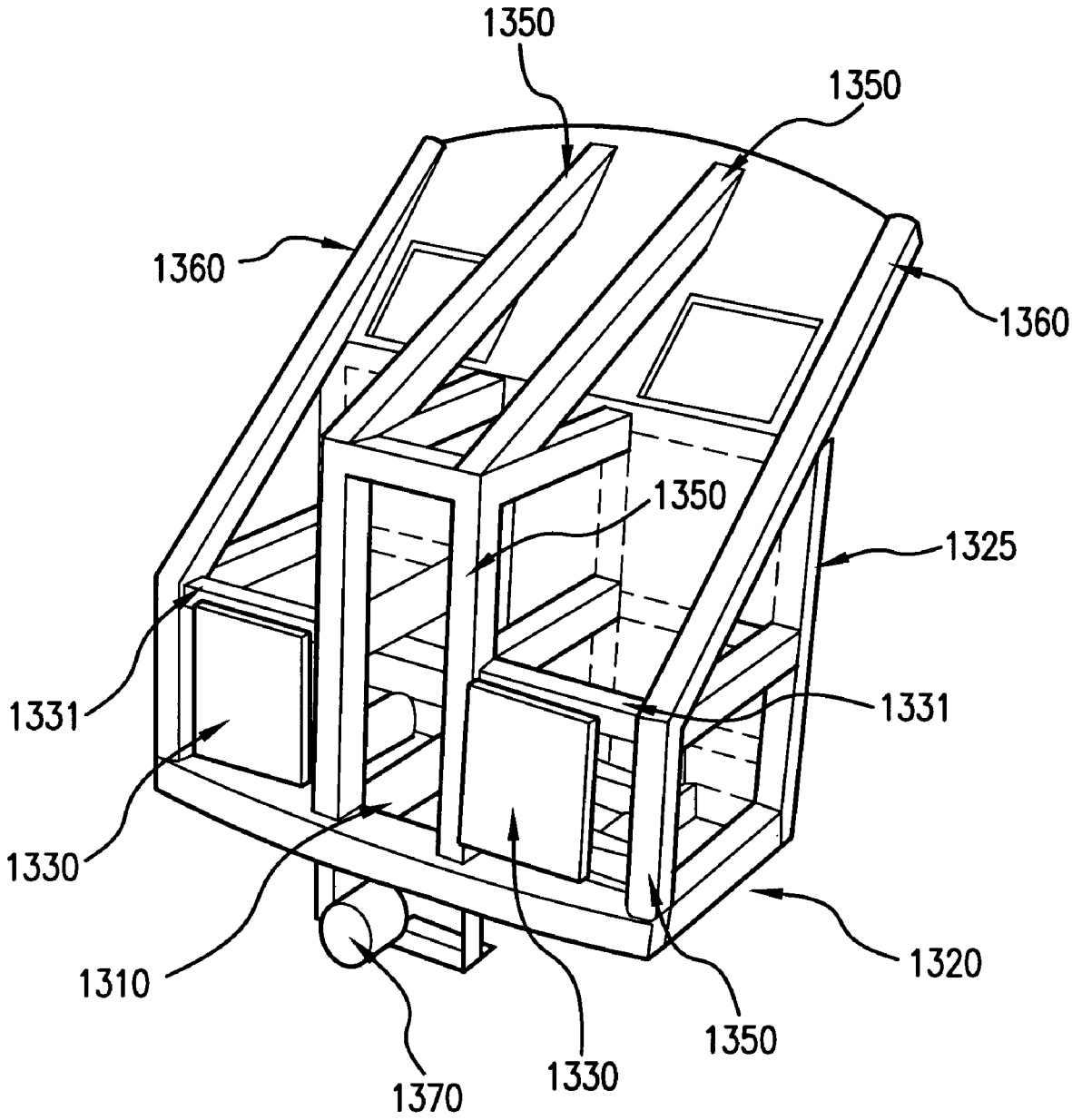
FIG. 13 is a perspective view of cab end crash energy management components of a crash energy management system according to a fifth embodiment of the invention.
Figure 14:
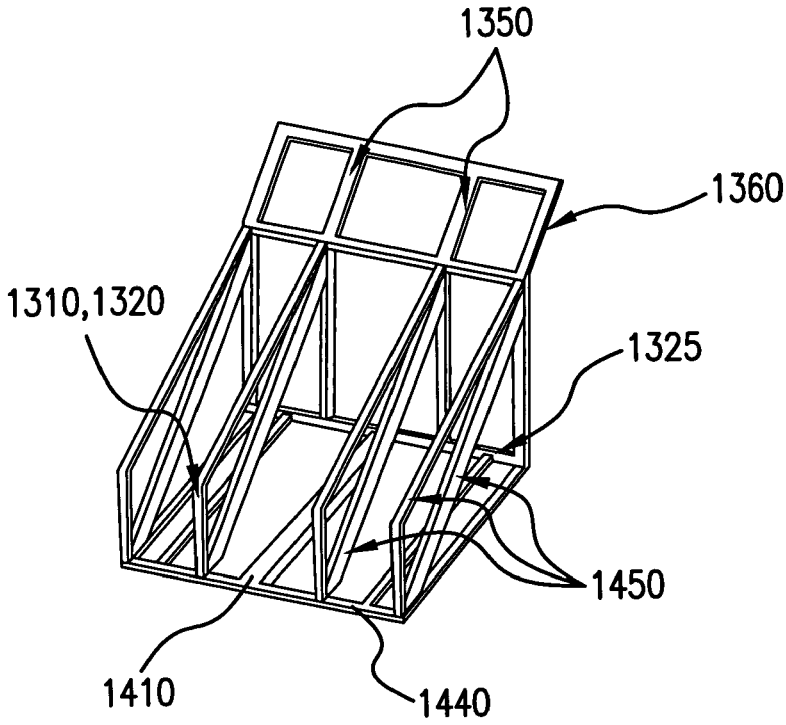
FIG. 14 is a perspective view of the various structural components of a cab end crash energy management system according to the fifth embodiment of the invention, with the cab car body removed from view.

FIGS. 13 and 14 show the locations of collision posts 1350 and corner posts 1360 for different possible implementations of a crush zone 1300 according to a fifth embodiment, for protecting the front end of the cab car of the first through fourth embodiments. As shown in the perspective cab end crush zone view of FIG. 13, the cab end crush zone 1300 includes a plurality of primary energy absorbers 1310, a plurality of secondary energy absorbers 1320, an end frame (post support box beam) 1325, and a plurality of load transfer plates 1330. FIG. 14 shows the support components provided for the cab end crush zone 1300, whereby the support components include collision posts 1350, corner posts 1360, primary and secondary absorbers 1310, 1320, a draft sill 1410, end sill beams 1440, and a collision/corner post support box beam 1325. Frangibles 1450 are also shown, which are support structures for the outer metal skin of the cab car.

Figure 15:
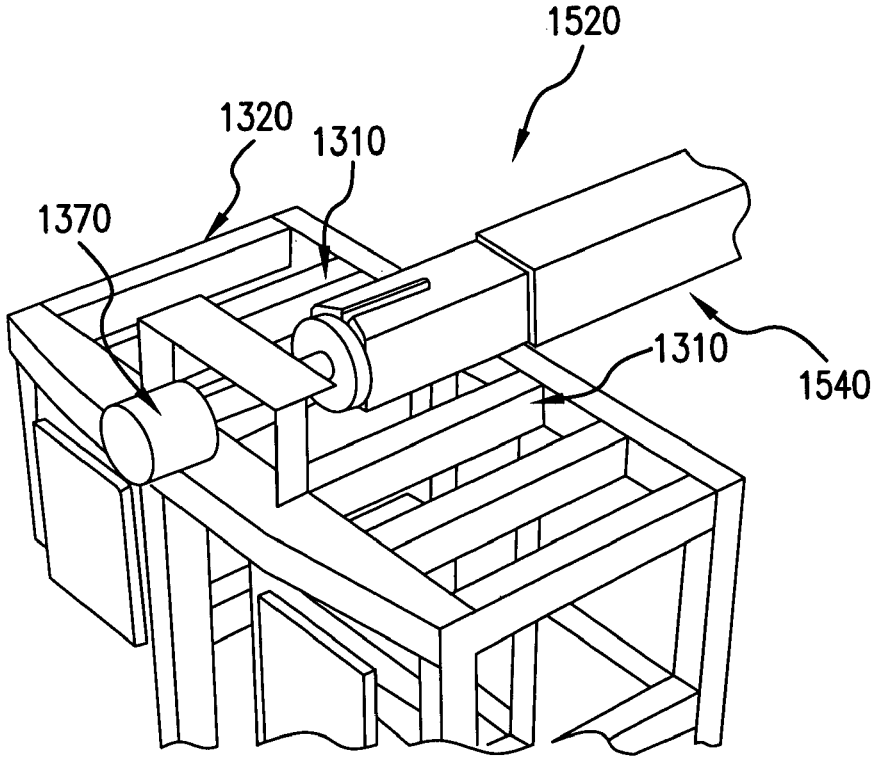
FIG. 15 is a bottom perspective view of the cab end components of the crash energy management system of FIG. 13.

FIG. 15 shows an underframe provided for the cab end crush zone according to the fifth embodiment. Push back coupler 1370, sliding sill 1520, shear bolts 1530 and end frame (fixed sill) 1540 can be readily seen in that figure.

In more detail, the crushable zone of the cab end is outboard of all occupied areas, with a vestibule wall separating the crushable zone from the passenger compartment, and with a metal skin that covers the crushable zone (to reduce wind resistance for a train that includes the cab car). A primary energy absorption system that includes the primary energy absorbers 1310 is located at the underframe level. A secondary energy absorption system that includes secondary energy absorbers 1320 is located above the underframe level at various levels behind the corner posts, in order to absorb energy and provide structure to help meet the post static requirements, and to act as guides to provide deflection of energy away from the passenger compartment.

Load is transferred from the contact points to the end frame through the load distribution transfer plates 1330. The load distribution transfer plates 1330 are supported by lateral members 1331 that are connected to the corner posts 1360 and the collision posts 1350. In operation, the upper, angled portion of the corner posts 1360 and the collision posts 1350 buckle during crush, in order to absorb some of the energy of the crash.

A coupler 1370 is also shown in FIGS. 13 and 15. The coupler 1370 is supported by a sliding sill 1520. The sliding sill 1520 is a large tube-shaped structure attached to a fixed sill 1540 by a fuse mechanism (such as shear bolts or pins). When the push back stroke of the coupler 1370 reaches a certain value (such as, for example, approximately 20 inches), the fuse mechanism is activated, and the coupler 1370 and sliding sill element 1520 move back into the fixed sill 1540. In one possible implementation, the outboard end of the sliding sill 1520 is connected to the rear end beam of the car's main underframe. Also, in the crush zone structure, the primary energy absorption elements are supported at their inboard ends by the main underframe structure of the cab car.

The underframe of the cab car according to the first and second embodiments includes two end underframes positioned at the front end and back end crush zones, with a central underframe that is connected to the two end underframes and respective ends of the central underframe. The end underframes may be made of LAHT material, whereas the central underframe of the cab car can be any of stainless steel or LAHT. Stainless steel is preferred for the central underframe to facilitate the formation of various profiles and due to ease of resistance welding.

For crash energy management considerations, the end structures are constructed to absorb specified amounts of collision energy, whereby the crush zones are provided to facilitate and accommodate a continuously progressive crush to maximum stroke (e.g., 38 inches of stroke), in addition to having additional space to accommodate the crushed material.

For static strength considerations, the draft sill 1410, the end sill 1440, the side sills 1420 and their respective connections are structured to withstand high compression and other forces and moments without exceeding specified stresses. Accordingly, the draft sill 1410 and the side sills 1420 are designed so that they are not easily crushed under accidental overloads in a normal sense of crushing, and whereby the draft sill 1410 and the side sills 1420 are provided so as to facilitate the progression of crush to the maximum stroke for proper absorption of the specified energy.

Figure 16:
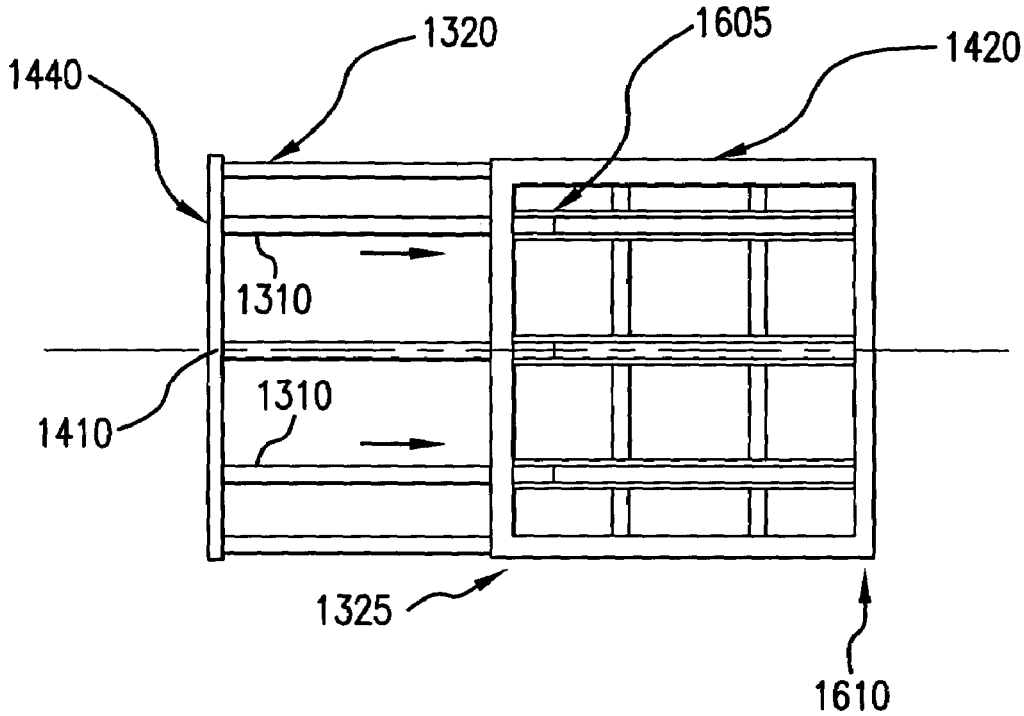
FIG. 16 is a top plan view of the cab end crash energy management system of FIG. 14, with the rail car body components removed from view.

In view of the above, sliding mechanisms are utilized in the end underframes to allow the side sills 1420 and the draft sill 1410 to slide backward in a controlled and measurable manner as crushable elements are successively consumed to the maximum stroke. FIG. 16 shows the sliding nature of the side sills 1420 and the draft sill 1410 provided at a cab end crush zone according to the fifth embodiment, whereby the side sills 1420 and the draft sill 1410 both slide inwards in the event of a crash. Also shown in FIG. 16 are an end sill 1440, the primary absorbers 1310, the secondary absorbers 1320, shear bolts 1605, and a body bolster 1610.

The body bolster 1610, the draft sill 1410, the end sill 1440 and the end portions of the side sills 1420 are the major load carrying members of the end underframe of the first and second embodiments. In order to facilitate proper load transfer, flanges and webs of major components are aligned to provide continuity and to avoid unnecessary eccentricities.

The end underframe of the cab car is constructed to withstand static end compression on the end sill 1440, static end compression on the line of draft, anti-climbing loads, coupler shank and coupler carrier loads, buffer beam loads, lateral bypass loads, and overturning loads as specified by FRA and other technical specifications. The end underframe also is structured to support loads resulting from the plastic bending failures of the collision posts and corner posts. In addition, the body bolster 1610 is utilized to transmit loads away from the rail car body, and the draft sill 1410 is utilized to transmit loads to the side sills 1410 and a center sill.

With respect to the central underframe, a center sill is utilized to meet the FRA longitudinal compressive load requirements and work in conjunction with the performance of the CEM structure according to the first and second embodiments. The center sill, which is positioned along a same axis as the draft sill 1410, provides longitudinal center support to the draft sill 1410 and offers continuity to the draft sill 1410, in tandem with the side sills 1420 provided on the sides of the cab car, thereby facilitating a controlled crush. The center sill also provides better camber control and improves the overall longitudinal and torsional stiffness of the cab car body.

Cross bearers and floor beams may also be installed at regular intervals in the central underframe, to prevent buckling of the center sill and to provide vertical load distribution to the center sill (and draft sill 1410) and the side sills 1420.

Such an underframe is expected to have better resistance to loads, including diagonal loads.

As discussed earlier, the draft sill 1410 moves with the crush zone in a controlled manner to allow for optimal operation of crash energy management. To facilitate draft sill movement with the progression of the crush zone, the draft sill 1410 contains a shearing mechanism. The portion of the draft sill 1410 within the crush zone will shear under a predetermined crush load and then slide into a fixed portion of the draft sill 1410 extending outboard of the body bolster 1610. By way of example and not by way of limitation, this movement can be set equal to the maximum specified stroke of 38 inches, for example.

By way of example and not by way of limitation, the coupler 1370 undergoes approximately 13.75 inches of deformation until the specified energy absorption has occurred. The coupler 1370 has a shear mechanism that will fail when a sufficient crash force occurs, allowing the coupler assembly to travel back into a draft sill cavity. By way of example and not by way of limitation, total longitudinal travel makes up for 20 inches of coupler push-back plus additional distance needed to accommodate CEM crush.

Two possible implementations for providing a sliding draft sill 1410 according to a cab car according to the first or second embodiments are described herein. One implementation has the coupler 1370 mounted on the fixed portion of the draft sill 1410, and the other implementation has the coupler 1370 mounted on the movable portion of the draft sill 1410.

For the first implementation in which the coupler 1370 is mounted on the fixed portion of the draft sill 1410, a cavity is provided within the draft sill 1410 to allow the coupler 1370 to travel backward into this free space (the cavity) during CEM system activation. A hollow cylinder may be mounted on the fixed portion of the draft sill 1410, or the coupler 1370 may also slide into the cavity of the fixed portion of the draft sill 1410. In this implementation, the draft sill shear mechanism and the coupler shear mechanism trigger at approximately the same time to allow progression of the crush zone. This implementation also uses a long shank coupler in order to span across the crush zone, whereby its length may be approximately 50 inches in one possible construction.

For the second implementation in which the coupler 1370 is mounted on the movable (e.g., the sliding) portion of the draft sill 1410, a shorter shank coupler than what is described with respect to the first implementation is utilized, since the coupler mounting moves with the draft sill 1410, and therefore is independent of any crush zone allowance.

With respect to the side sills 1420 in the crush zone according to the fifth embodiment, the end portions of each side sill 1420 shear off and slide into a fixed portion of each side sill, in concert with the collapse of the crush zone. The shearing mechanism may contain rivets, bolts, pins, and/or weldments.

Figure 17:
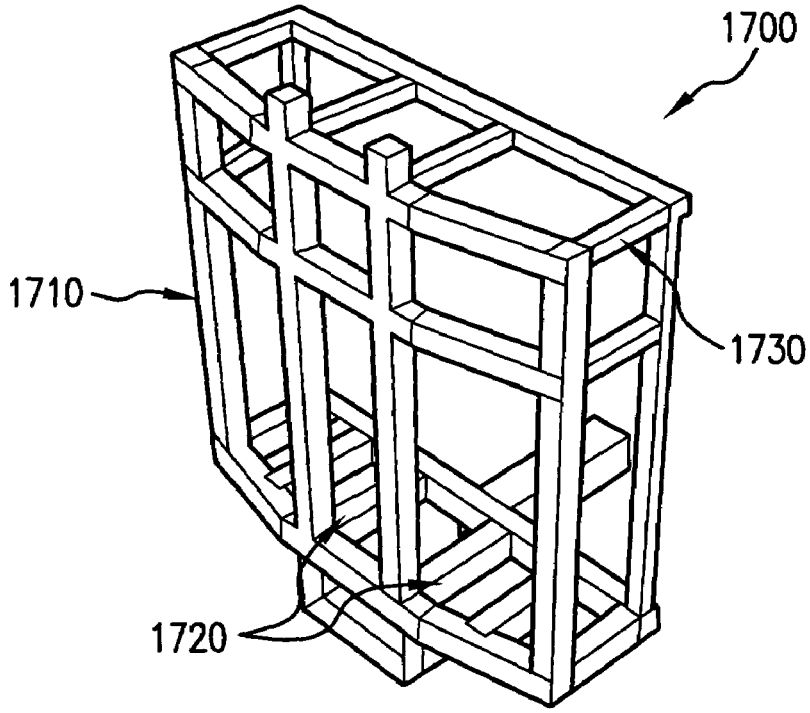
FIG. 17 is a perspective view of non-cab end crash energy management components of a crash energy management system according to a sixth embodiment of the invention.

A cab car non-cab (rear) end crush zone structure 1700 according to a sixth embodiment is shown in FIG. 17, and includes an end frame load distribution transfer structure 1710, primary absorbers 1720, and second absorbers/plates/guide tubes 1730. The end frame load distribution transfer mechanism includes a plurality of horizontally and vertically positioned posts, with the primary and secondary absorbers 1720, 1730 provided between front and back sides of the end frame load distribution transfer structure 1710. The cab car non-cab end crush zone 1700 absorbs the crash and thereby lessens the impact of the non-cab end of the first cab car of a train with the front end of a second car of the train, whereby the second and other cars may have their own front and back end crush zones similar in construction to the non-cab end crush zone of the cab car.

Other major cab carbody structure includes floors, roof, sides, equipment mounting brackets, and pilots. The upper level floor is structured to carry maximum passenger loads, and provisions are made for HVAC ducts, lighting and other fixtures. The roof structure is structured to support rollover loads and maintenance crew loads. In addition, roofs may also be subject to car wash loads caused by pressure and velocity of pressure washers. The side structure, in addition to supporting vertical loads, also is structured to carry rollover and side impact loads, such as the loads set forth in APTA standards. Equipment mounting brackets are provided to support heavy equipment, such as equipment heavier than 150 pounds. Cab ends of cab cars may be provided with pilots having clearances to prevent objects from going under the car, whereby the pilots may be constructed to carry the specified loads.

With the crush zone provided at the front end of the cab car and with the control cab provided at a top level of cab car behind the crush zone, the operator is positioned further back from the front end as compared to conventional cab cars that do not have CEM. This provides additional protection for the operator due to the higher position and set-back-from-front location of the control cab.

Figure 18:
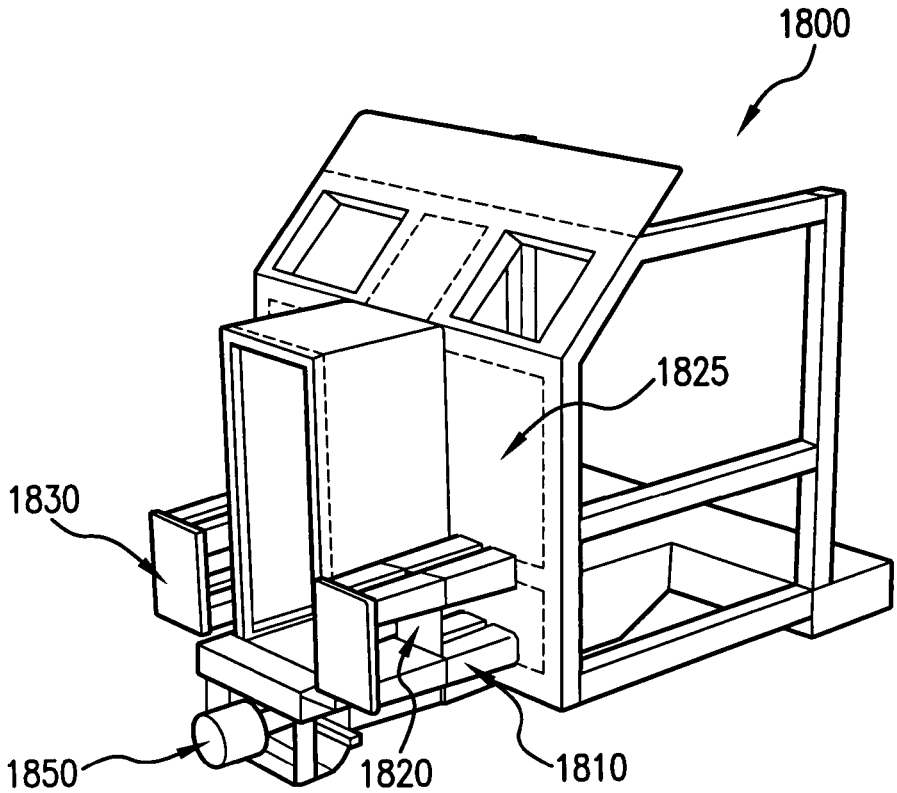
FIG. 18 is a perspective view of a cab end crash energy management system according to a seventh embodiment of the invention.

A cab end crush zone structure 1800 according to a seventh embodiment is shown in FIG. 18. The cab end crush zone structure 1800 includes primary absorbers 1810, an absorber tie plate 1820 (one provided at each side of the front side door), an end frame 1825, and load transfer plates 1830 (one provided at each side of the front side door). A coupler 1850 that is a part of the underframe structure of the cab end is also shown in FIG. 18. The absorber tie plate 1820 is provided for crush stability.

Figure 19:
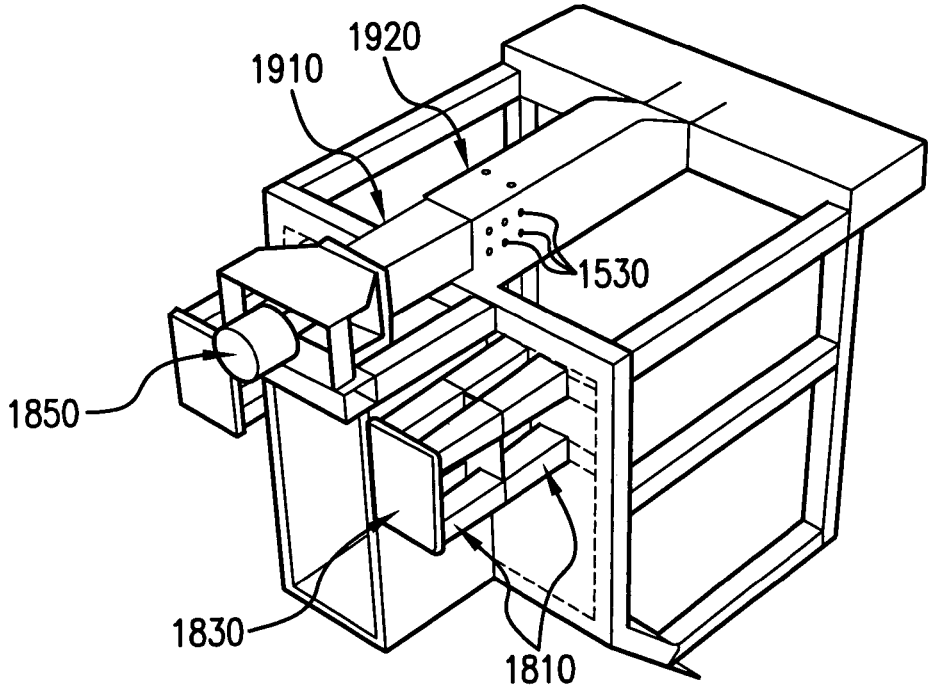
FIG. 19 is a bottom perspective view of the cab end crash energy management system of FIG. 18.

The underframe structure for the crush zone 1800 is shown in FIG. 19, and includes a coupler 1850, a sliding sill 1910, and a fixed sill 1920, which operates similar to the operation of the underframe structure as shown in FIG. 15. The primary absorbers 1810 are provided as a set of four (4) absorbers both on a front side and a back side of the absorber tie plate 1820, for crush stability. Accordingly, eight (8) primary absorbers 1810 are utilized in the seventh embodiment. A secondary absorption system (not shown in FIG. 19 but see FIG. 14) may also be utilized in the crush zone 1800 of the seventh embodiment.

Figure 21:
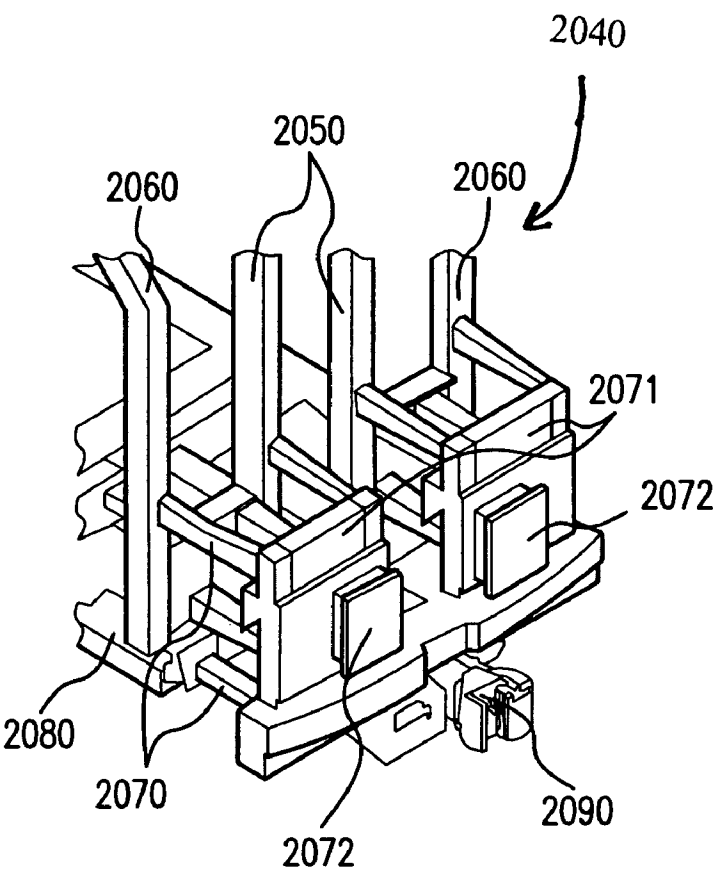
FIG. 21 is a perspective view of a cab end crash energy management system of FIG. 20, showing collision posts and corner posts behind the crash energy management system and at the end of the zone occupied by passengers and the car operator.
Figure 20:
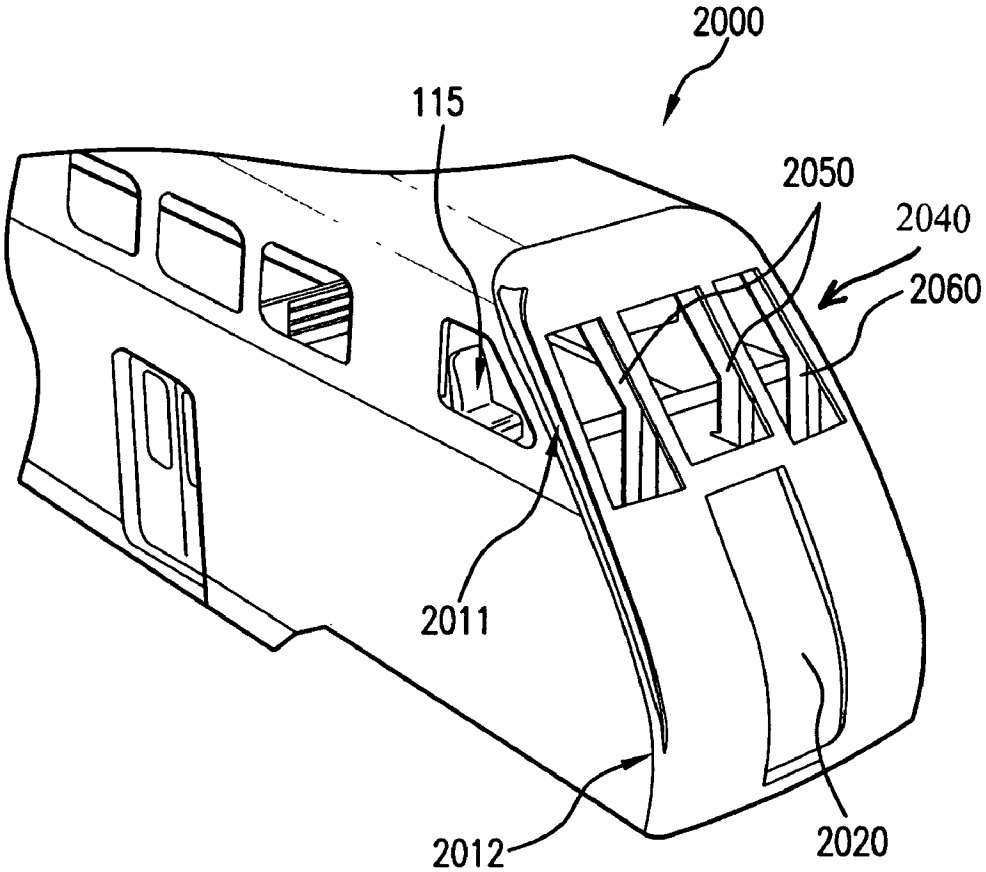
FIG. 20 is a perspective view of the outside of a front portion of a cab car according to an eighth embodiment of the invention.

In an eighth embodiment, as shown in FIG. 20, a top portion 2011 of substantially the entire width of the front end of the cab car 2000 is slanted, except for a lower portion 2012 that is not slanted (or that has a minor slant in some possible configurations). A door 2020, which is provided at the middle part of the front end according to the eighth embodiment, is also slanted at the same angle as the top portion 2011 and bottom portion 2012. The slant of the top portion 2011 of the front end may be set at a value between 30 degrees and 60 degrees from vertical. Other possible angles of the slanted and non-slanted portions of the front end are contemplated, while remaining within the spirit and scope of the invention. In FIGS. 20 and 21, an end frame 2040 including the collision posts 2050 and corner posts 2060 may be seen. The collision posts 2050 and corner posts 2060 do not extend out towards the very end of the front end of the cab car 2000. The collision posts 2050 and corner posts 2060 include a slanted portion that reaches from a top portion of the cab car 2000 toward a front end of a control cab 115 and a substantially vertical portion that is rearward of the outer skin of the cab car 2000 and a crush zone of the crash energy management region.

The components of the crash energy management region of the eighth embodiment are shown in FIG. 21. The cab end crush zone structure includes primary absorbers 2070, secondary absorbers 2080, lateral members 2071 and load distribution transfer plates 2072 (one provided on each side of the front end door 2020). A coupler 2090 that is part of the underframe structure of the cab end is also shown in FIG. 21. The primary energy absorbers 2070 extend substantially perpendicular to the collision posts 2050 and corner posts 2060, and the primary energy absorbers 2070 connect (directly or indirectly) the load distribution transfer plates 2072 to the front end of the cab car 2000. As can be seen in FIGS. 20 and 21, the crush zone is located forward of and below the control cab 115 for an operator.

According to another embodiment of the invention, equipment lockers may be located within the CEM structural area.

Embodiments of the present invention have been described in detail. Other embodiments of the invention will be apparent to those skilled in the art from consideration of the specification and practice of the invention disclosed herein, which are considered as exemplary only. For example, while the embodiments have been described with respect to a bilevel cab car that is a part of a train having other cars, the features described above with respect to cab cars are also applicable to other rail cars without propulsion means or other rail cars with their own propulsion units, such as bilevel Multiple Unit (MU) cars, which have their own traction motor(s) or other means of propulsion for moving a train of cars that includes the car with the control cab, irrespective of whether any other cars of the train have propulsion unit(s); bilevel Diesel Multiple Unit (DMU); bilevel Electrical Multiple Unit (EMU) cars; or any other passenger rail cars that have their own means of propulsion.

What is claimed is:

1. A passenger rail car, comprising:

a lower passenger compartment that includes a plurality of passenger seats;

an upper passenger compartment that includes a plurality of passenger seats;

a front crash energy management region having a crush zone structure provided at a front end of the rail car;

a control cab for a rail car operator at the upper passenger compartment level, the control cab being forward of the passenger seats of the upper passenger compartment and behind the crush zone structure; and an end frame comprising two corner posts and two collision posts, the end frame being positioned forward of the control cab and behind the crush zone structure.

2. The passenger rail car according to claim 1, further comprising:

a middle compartment including a front portion at a front end of the rail car and a rear portion at a rear end of the rail car;

a first entrance door provided at one end of the middle compartment front portion; and a second entrance door provided at an end of the middle compartment rear portion, wherein the first and second entrance doors enable one or more passengers to move to and from the passenger rail car and adjacent rail cars.

3. The passenger rail car according to claim 1, wherein the control cab is provided on only one side of the passenger rail car with respect to a widthwise direction of the cab car.

4. The passenger rail car according to claim 1, further comprising:

an exterior housing, the exterior housing having a substantially vertical portion at one end of the passenger rail car and having a substantially slanted portion at an opposite end of the passenger rail car.

5. The passenger rail car according to claim 4, wherein the substantially slanted opposite end of the passenger rail car comprises:

a slanted upper portion; and a substantially vertical lower portion.

6. The passenger rail car according to claim 4, wherein the substantially slanted opposite end of the exterior housing is located adjacent the control cab for the rail car operator.

7. The passenger rail car according to claim 4, wherein the exterior housing further comprises:

at least one door provided on one side of the passenger rail car that is located orthogonal to a direction of travel of the passenger rail car; and at least one door provided on another side of the passenger rail car that is also located orthogonal to the direction of travel of the passenger rail car.

8. The passenger rail car according to claim 1, wherein an aisle on the level of the upper passenger compartment provides access to and from the control cab.

9. The passenger rail car according to claim 8, wherein the aisle is adjacent at least one passenger seat.

10. The passenger rail car according to claim 1, further comprising a rear crash energy management region comprising a second crush zone structure provided at a back end of the passenger rail car.

11. The passenger rail car according to claim 1, wherein the lower passenger compartment is positioned approximately 25" above top of rail, the upper passenger compartment is positioned between approximately 104" above the top of rail, and further comprising a middle compartment positioned approximately 51" above the top of rail.

12. The passenger rail car according to claim 1, further comprising a middle compartment which includes a plurality of passenger seats.

13. The passenger rail car according to claim 12, wherein the middle compartment comprises a front portion.

14. The passenger rail car according to claim 13, wherein the middle compartment further comprises a rear portion.

15. A passenger rail car, comprising:

a slanted front end;

a control cab for a rail car operator that is provided adjacent the slanted front end at a position within an upper half section of the passenger rail car;

a door provided on the slanted front end, for allowing passengers to enter and exit the passenger rail car;

a front crash energy management region having a crush zone structure provided at a front end of the rail car; and an end frame comprising two corner posts and two collision posts, the end frame being positioned forward of the control cab and behind the crush zone structure.

16. The passenger rail car according to claim 15, wherein the door includes a first door portion and a second door portion which are capable of closing the door by the first and second door portions coming into contact with each other, and which are capable of opening the door by at least one of the first and second door portions moving away from the other one.

17. The passenger rail car according to claim 15, wherein the door does not extend outward from the slanted front end.

* * * * *